US005669683A

United States Patent [19]

Moss et al.

[11] Patent Number: 5,669,683

[45] Date of Patent: Sep. 23, 1997

[54] DISPLAY SHELF ASSEMBLY

[75] Inventors: William F. Moss, Canonsburg; Tricia Knezevich, McMurray, both of Pa.

[73] Assignee: Union Camp Corporation, Princeton, N.J.

[21] Appl. No.: 516,406

[22] Filed: Aug. 17, 1995

Related U.S. Application Data

[63] Continuation-in-part of Ser. No. 128,648, Sep. 30, 1993, Pat. No. 5,458,411.

[51] Int. Cl.[6] ..... A47B 43/02

[52] U.S. Cl. ..... 312/259

[58] Field of Search ..... 312/194, 195, 312/258, 126, 259, 128, 262, 108, 263; 108/165, 180, 100; 211/85, 135, 186

[56] References Cited

U.S. PATENT DOCUMENTS

| | | | |
|---|---|---|---|
| 3,307,767 | 3/1967 | Humphrey et al. | 312/259 X |
| 3,987,737 | 10/1976 | Smith | 211/149 X |
| 4,124,260 | 11/1978 | Bergman | 312/259 X |
| 4,519,319 | 5/1985 | Howlett | 312/259 X |
| 4,570,805 | 2/1986 | Smith | 211/149 |
| 4,942,830 | 7/1990 | Macaluso et al. | 312/259 X |
| 5,143,431 | 9/1992 | Udell | 312/259 |
| 5,315,936 | 5/1994 | Smith | 312/259 X |
| 5,458,411 | 10/1995 | Moss | 312/259 |

*Primary Examiner*—James R. Brittain
*Assistant Examiner*—Robert J. Sandy
*Attorney, Agent, or Firm*—Dennis H. Lambert, Esq.

[57] ABSTRACT

An inexpensive, strong, fully recyclable and easy to assemble display shelf assembly made from folded blanks of corrugated liner board, includes a support housing having a back panel with side panels extending forwardly from opposite edges thereof. Each side panel has an inner wall and a spaced, parallel outer wall connected by narrow panels at their opposite edges, defining box-like structures. A plurality of slots are formed in the opposite, confronting inner walls, and a plurality of shelf units have their opposite ends received in respective slots to support the shelf units on the support housing. Each shelf unit is made from folded blanks of corrugated liner board so that a substantially unbroken top surface is provided, with box beam structures beneath and supporting the top surface.

20 Claims, 17 Drawing Sheets

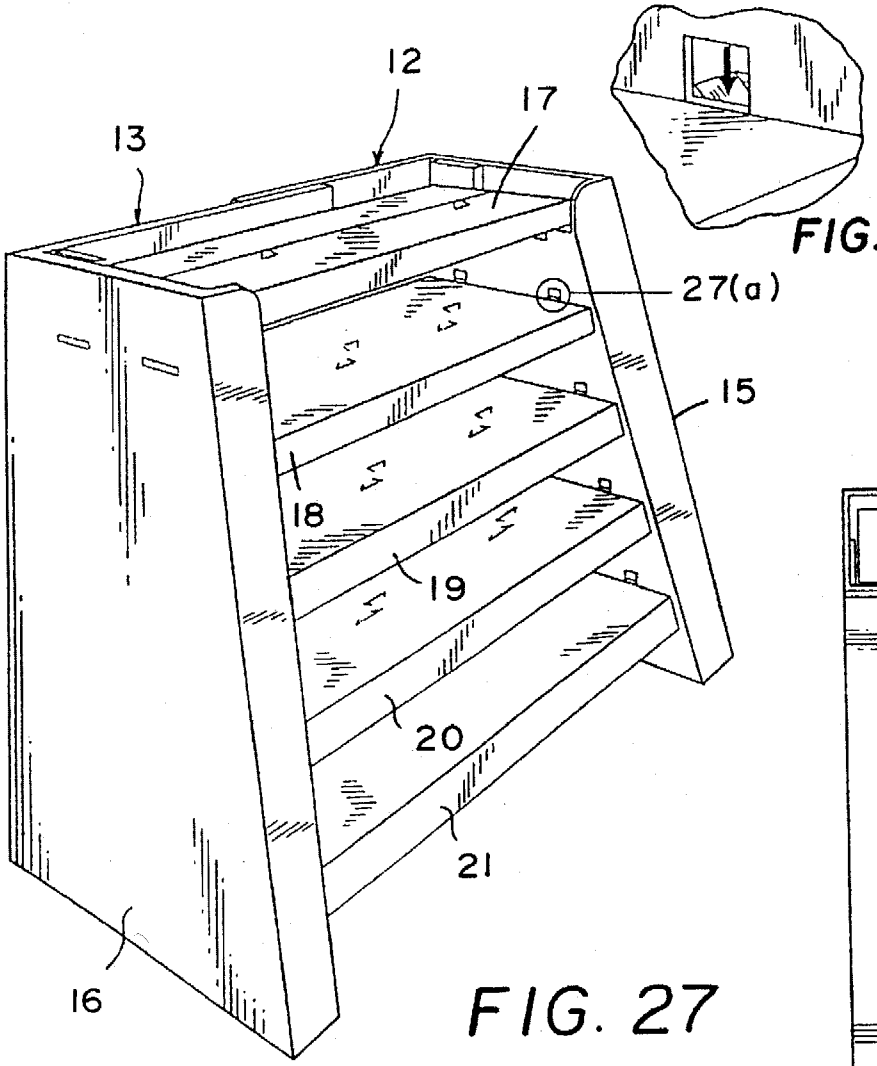
FIG. 27
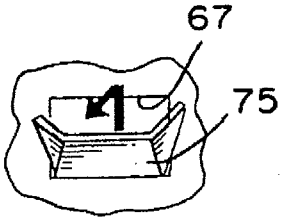
FIG. 27(a)
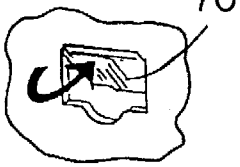
FIG. 28(a)
FIG. 28(b)
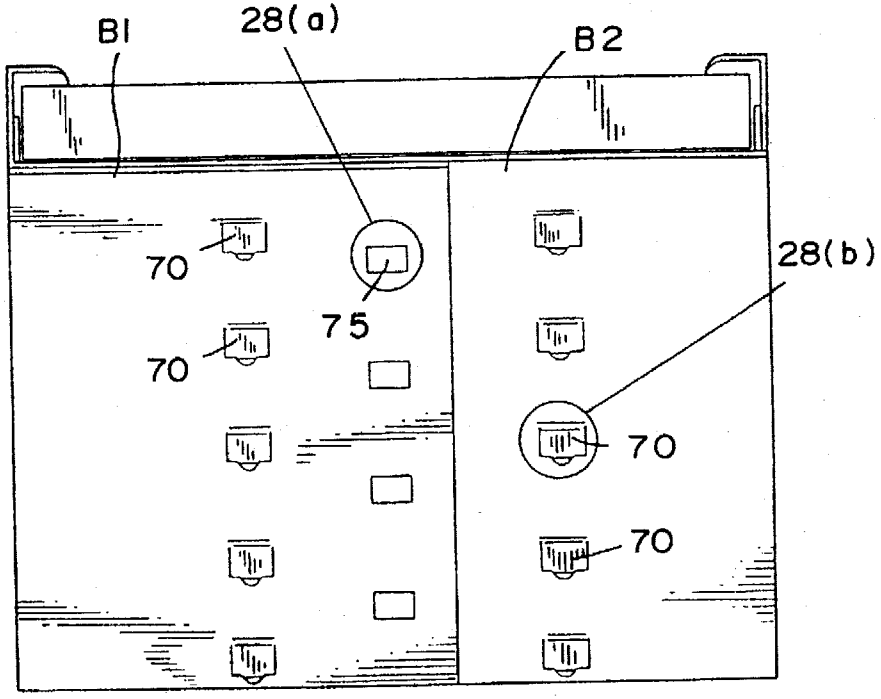
FIG. 28

DISPLAY SHELF ASSEMBLY

This application is a continuation-in-part of application Ser. No. 08/128,648, filed Sep. 30, 1993, now U.S. Pat. No. 5,458,411, and entitled Display Shelf Unit.

FIELD OF THE INVENTION

This invention relates to display racks, and, more particularly, to a display shelf assembly formed from folded blanks of corrugated liner board for recycling, economy and strength.

DESCRIPTION OF THE PRIOR ART

Many different types and styles of display racks are known in the art for displaying merchandise at the point of sale. Conventional display racks range from all metal units to assemblies made from paperboard and/or other materials.

Metal units are relatively expensive and heavy and are generally pre-assembled by the manufacturer, or are shipped to the merchandiser in partially assembled form, thereby requiring excessive shipping space. Moreover, some merchandisers do not exercise care in the handling and use of the display racks and damage or dispose of them after only a short period of use. Further, metal display racks may not be easily recyclable, or if disposed of may not easily decompose. Because of the relatively high cost of metal display racks, this activity increases the cost to the merchandiser or to the vendor who supplies the racks for display of its products.

Prior art display racks made from paperboard and similar materials are relatively complex and expensive in construction, and/or do not possess adequate strength. For instance, the racks are frequently used for products not intended to be displayed on the rack and the rack may fail or sag if much heavier product is displayed than was intended during the design of the rack.

Further, although paperboard display racks may be shipped to the merchandiser in unassembled form, i.e., typically flat blanks of material which must be folded and assembled together to construct a completed display rack, the assembly may be difficult for a novice to accomplish. Additionally, many prior art racks of this type may have inadequate display space or may obscure the displayed merchandise behind components of the display rack itself.

Other display racks require the use of adhesives and/or hardware such as rods, rivets, staples, and the like, in their construction and assembly, and may not be readily recyclable or decomposable when discarded.

Accordingly, there is need for a display rack which is inexpensive and simple in construction and assembly and which possesses superior strength, while at the same time affording maximum visibility to the displayed merchandise, and which is readily recyclable. Further, there is a need for such a display rack which may be shipped to the point of sale in unassembled form and quickly and easily assembled by the merchandiser without requiring the use of adhesives and/or hardware such as wooden rods, plastic rivets, etc.

SUMMARY OF THE INVENTION

The invention comprises a display shelf assembly formed entirely of corrugated liner board, having a plurality of spaced shelves extending between side supports. The shelves are constructed from paperboard that is folded in a way to impart strength to the shelves, and when in use there is maximum exposure of the merchandise supported and displayed on the shelves. The display shelf of the invention is inexpensive and easy to assemble, and yet it is stronger than comparable conventional display units made from paperboard, and is even stronger than many conventional display units in which metal components are used. Further, the display shelf assembly of the invention does not require the use of adhesives or hardware in its assembly, and is readily recyclable.

The display shelf assembly is shipped in unassembled form, comprising a minimum number of separate components that may be quickly and easily assembled at the point of use. The components include flat blanks that are folded to form structural subassemblies, which are then secured together by use of tabs and slots, eliminating the need for separate fasteners such as staples, glue or tape.

More particularly, the display shelf assembly of the invention comprises a pair of substantially mirror image main support subassemblies, each of which includes a back panel and a multi-wall side panel projecting forwardly at a right angle to the back panel. When assembled, the back panels overlap one another and are secured together by interfitting tab and recess means, and the multi-wall side panels have inner walls in spaced, opposing relationship to one another, with a plurality of vertically spaced, horizontally extending, elongate slots formed in the opposing walls for receiving therein the opposite ends of elongate shelf units disposed horizontally in front of the back panels and extending between the opposed side panels. Interfitting tab and recess means are on the back panels and shelves and on the side panels and shelves for securing the shelves to the back panels and side panels.

The multi-wall side panels are formed by folding from one edge the blank that is used in forming each support subassembly, and securing the folded portion in its folded relationship by use of interengaged tab and recess means. Similarly, the shelves are each formed from a single blank by folding the material of the blank inwardly from opposite edges thereof toward the center and securing the blank in its folded relationship to form a shelf unit having a substantially uninterrupted top surface and a box beam structure underneath multi-wall thickness for added strength and stability.

The display shelf assembly of the invention is formed entirely by folding blanks of corrugated liner board material and does not require the use of any adhesives, staples, pins or other fastening means. The display shelf assembly of the invention is recyclable and is capable of supporting substantial weight in comparison with conventional display shelves. Moreover, it is relatively economical to manufacture and easy to assemble.

The display shelf assembly of the invention may be used singly, e.g., as a freestanding end cap display, or two units may be placed back-to-back, or four units may be arranged together to form an island display, with each of the four units facing outwardly in a different direction, or in any other arrangement, as desired.

Because of the superior strength of the display rack of the invention, it may safely be used to display relatively heavy products, including some products that are not intended for the rack. Moreover, if the rack of the invention becomes damaged or no longer useful it may be discarded at an insignificant cost to the merchandiser or vendor whose goods are intended to be displayed on the rack. Further, because it is made entirely of paperboard, the display shelf assembly of the invention is easily recyclable or decomposed.

BRIEF DESCRIPTION OF THE DRAWINGS

The foregoing as well as other goals and advantages of the invention will become apparent from the following detailed description when considered in conjunction with the accompanying drawings, wherein like reference characters designate like parts throughout the several views, and wherein:

FIGS. 27 and 28 illustrate the final steps in assembling the shelf display assembly of the invention.

Figure 1:
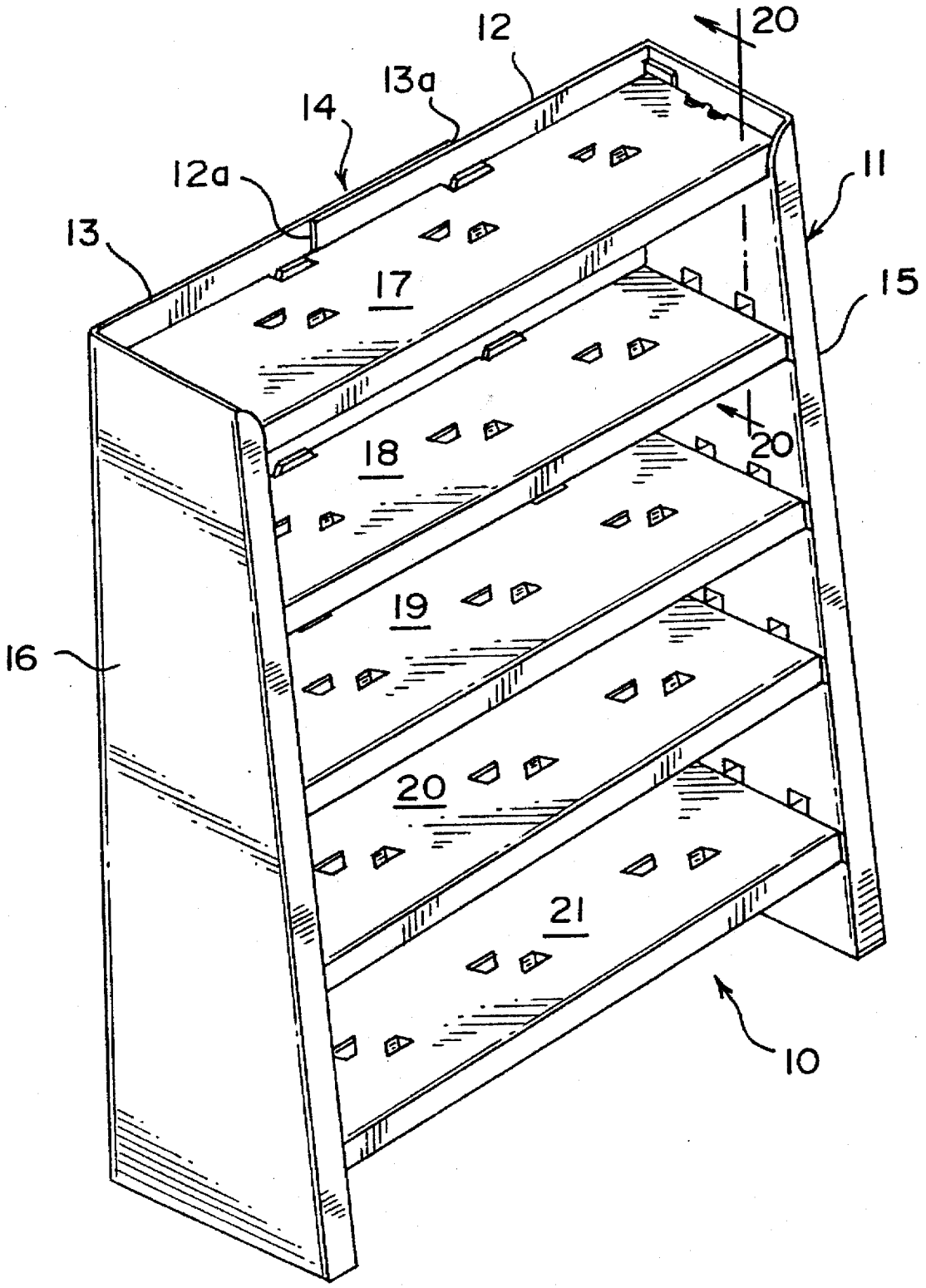
FIG. 1 is a top, front perspective view of a display shelf assembly according to the invention.

DETAILED DESCRIPTION OF THE PREFERRED EMBODIMENTS:

Referring more particularly to the drawings, a display shelf assembly according to the invention is indicated generally at 10. The display shelf assembly includes a support housing 11 comprising substantially mirror image left and right side support members 12 and 13 connected together to form a support having a back wall or panel 14 and opposed, parallel side walls or panels 15 and 16. A plurality of elongate, parallel shelves 17, 18, 19, 20 and 21 are supported at their opposite ends on the end panels 15 and 16 and are also connected to and supported at the back panel 14. In a preferred embodiment, the side panels 15 and 16 are wider at their bottom ends than at their top ends, and successively lower shelves are also correspondingly wider in a front to rear direction.

As seen best in FIGS. 3 and 20–25, the end panels 15 and 16 are of multi-wall construction, having spaced, parallel inner and outer walls 23 and 24. The inner wall 23 has a foldable flap 25 at its upper end, which is folded outwardly toward the outer wall 24 and in perpendicular relationship thereto to define an upwardly facing shoulder. The inner wall is also cut at successive, equally spaced intervals along its height, defining a plurality of foldable flaps 26, 27, 28 and 29 throughout the height of the side panel, and when these flaps are folded upwardly toward the outer wall 24 about fold lines 30, a series of elongate slots or openings 31, 32, 33 and 34 are formed in the inner wall 23 at regularly spaced intervals throughout the height of the side panel and extending parallel to one another in perpendicular relationship to the rear wall 14.

Opposite ends of the top shelf 17 are supported on the upwardly facing shoulders 25 and 25*a* formed on the opposite side panels 15 and 16, respectively, and the opposite ends of successively lower shelves are received in the successively lower pairs of opposed slots 31–31*a*, 32–32*a*, 33–33*a*, and 34–34*a*, respectively.

Figure 4:
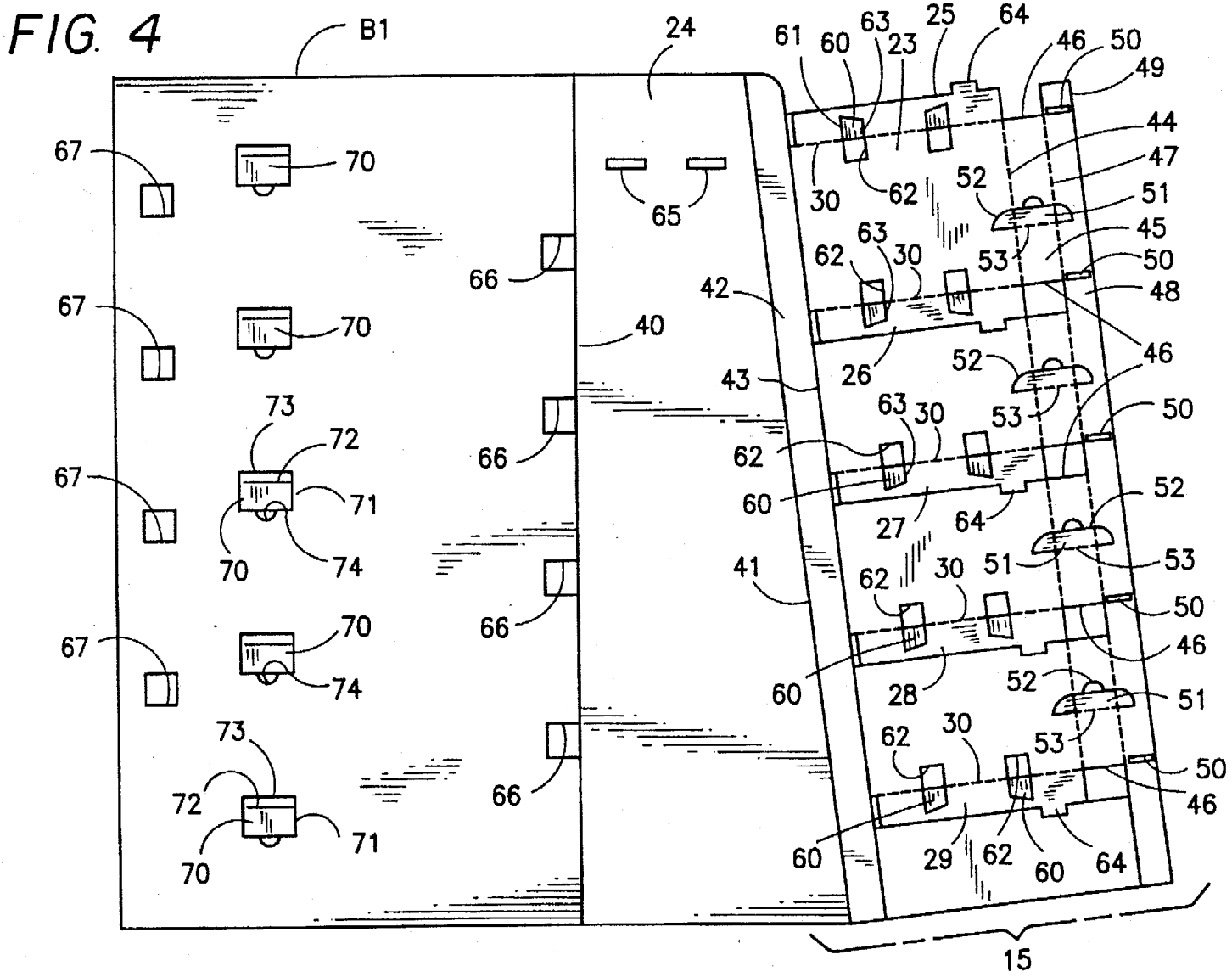
FIG. 4 is a plan view of the blank which forms the right side support member as viewed in FIGS. 1—3, showing the various score lines, cuts, openings, tabs and fold lines that are formed in the blank to enable the sub-assembly to be erected and engaged with the shelves to form the display shelf assembly of the invention.

Details of construction of the right hand support member 12 are seen best in FIGS. 4 and 22–24. The unfolded blank from which the right hand support 12 is formed is shown in FIG. 4. The blank includes a large rectangular panel B1 at one end joined by a fold line 40 to a trapezoidally shaped panel 24 that defines the outer wall in side panel 15 in the erected support. Panel 24 is, in turn, connected via a fold line 41 with an elongate, narrow, rectangular panel 42 that forms the front edge of the side panel 15 when the support 12 is fully erected. Panel 42 is joined via a fold line 43 with a further rectangular panel that forms the inner wall 23 when the support 12 is erected. Panel 23 is, in turn, joined via a fold line 44 with an elongate, narrow, rectangular panel 45 that forms the back edge of side panel 15 in the erected support, and when fully assembled the panel 45 lies flush against panel B1. Panel 45 includes a series of cut outs or openings 46 spaced along its length in alignment with the ends of flaps 25–29.

Panel 45 is joined via a fold line 47 with a further rectangular panel 48 of substantially the same width as panel 45, but extending at its upper end 49 above cut-out 46. When the support is erected, this panel 48 extends forwardly on the inside of outer wall 24 and lies flush against it. A series of small rectangular slots or cut outs 50 are formed in the panel 48 spaced along its length in substantial alignment with the fold lines 30 for the panels 25–29.

It should be noted that the fold lines 30, 44 and 47 are perforated to facilitate bending along these fold lines and aid in the erection of the support, while the other fold lines are creased. Of course, it is to be understood that the fold lines could be formed in any suitable, desired way.

A plurality of tabs 51 are formed in panel 45 by a score line or cut 52 extending laterally outwardly from the fold lines 44 and 47 into the panels 25 and 48, and thence curving upwardly and inwardly toward one another across the panel 48. The tabs 51 are joined to the panel 45 by fold lines 53 extending across the width of the panel 45. Further, it will be noted that the opposite ends of tabs 51 extend across the fold lines 44 and 47, thereby defining fold lines in the tabs 51 which enable the opposite ends of the tabs to be folded inwardly relative to that portion which extends across the panel 4, 5. This facilitates pulling of the tabs 51 through associated openings as described hereinafter.

A pair of tabs 60 are also formed in each of the foldable flaps or panels 25–29, by score lines or cuts 61 extending around two sides of the tabs, and an associated clearance opening or cut-out 62 formed in the associated panel 23 on the opposite side of fold lines 30–34, respectively, from the tab. The tabs 60 are joined to their respective panels 25–29 by fold lines 63 so that when the panels are folded to their operative positions, the tabs extend downwardly (or upwardly in the case of the top shelf) for engagement with an associated shelf. (See FIGS. 1, 3, 4, 21, 22, 24 and 25).

Further, it will be noted that each flap or panel 25–29 has a relatively narrow tab 64 projecting from its free edge adjacent panel 45. When the panels are folded to erect the support these tabs 64 extend into the slots 50 in panel 48. In this regard, a pair of slots 65 are formed near the top of panel 24 and the tab 64 on panel 23 extends into one of these slots to lock the panel 25 in its horizontal position when the support is erected.

Figure 23:
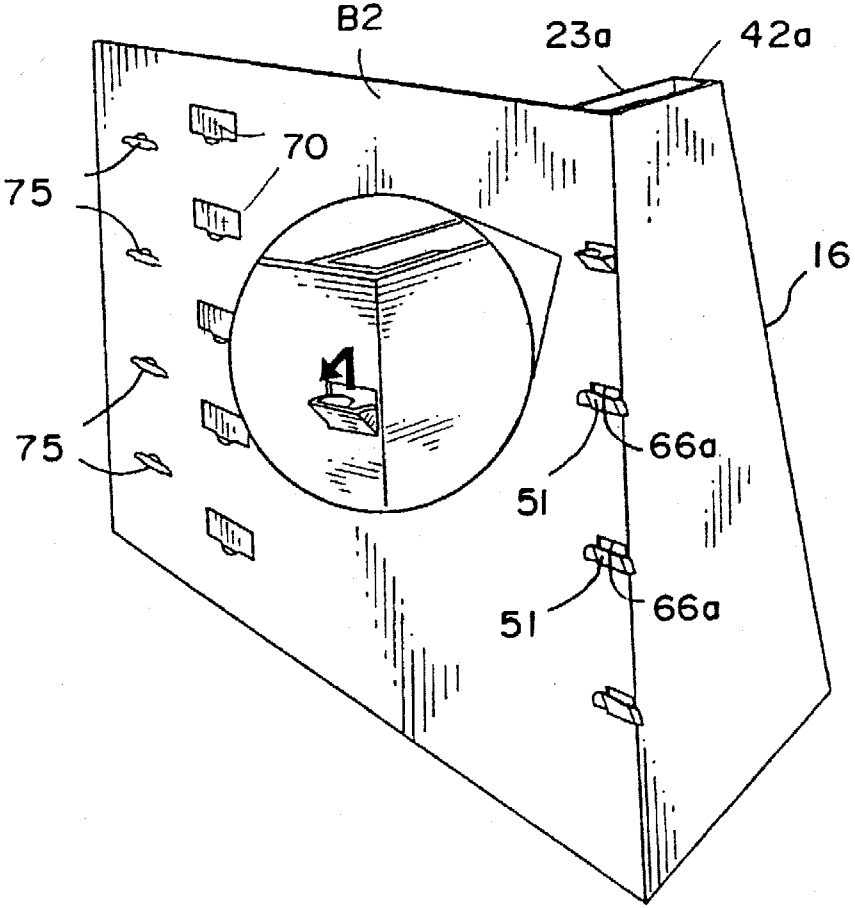

A plurality of openings 66 are formed in the edge of panel B1 adjacent fold line 40 for cooperation with the tabs 51 when the support is erected. In other words, when the panels 23, 42, 45 and 48 are folded about their respective fold lines, the tabs 51 come into registry with the openings 66 and they may then be grasped and pulled through the openings 66 as shown in FIG. 23 to lock the support in the position shown in that figure.

Panel B1 has a series of regularly spaced rectangularly shaped openings 67 adjacent the edge opposite fold line 40 for cooperation with tabs on the left hand support 13, as described hereinafter to secure the left and right side supports together.

Additionally, a plurality of tabs 70 are formed in the panel B1, spaced inwardly from openings 67, by score line or cut 71 extending around three sides of the tab. The tab is joined to the panel B1 by a pair of spaced parallel fold lines 72 and 73 so that when the tab 70 is folded about the fold lines 72 and 73 it will lie parallel to and spaced slightly from the plane of the panel B1 (refer to FIG. 3). A finger recess or access, opening 74 is formed at the bottom of each tab 70 to facilitate engagement and lifting of the tab during assembly of the invention.

Figure 2:
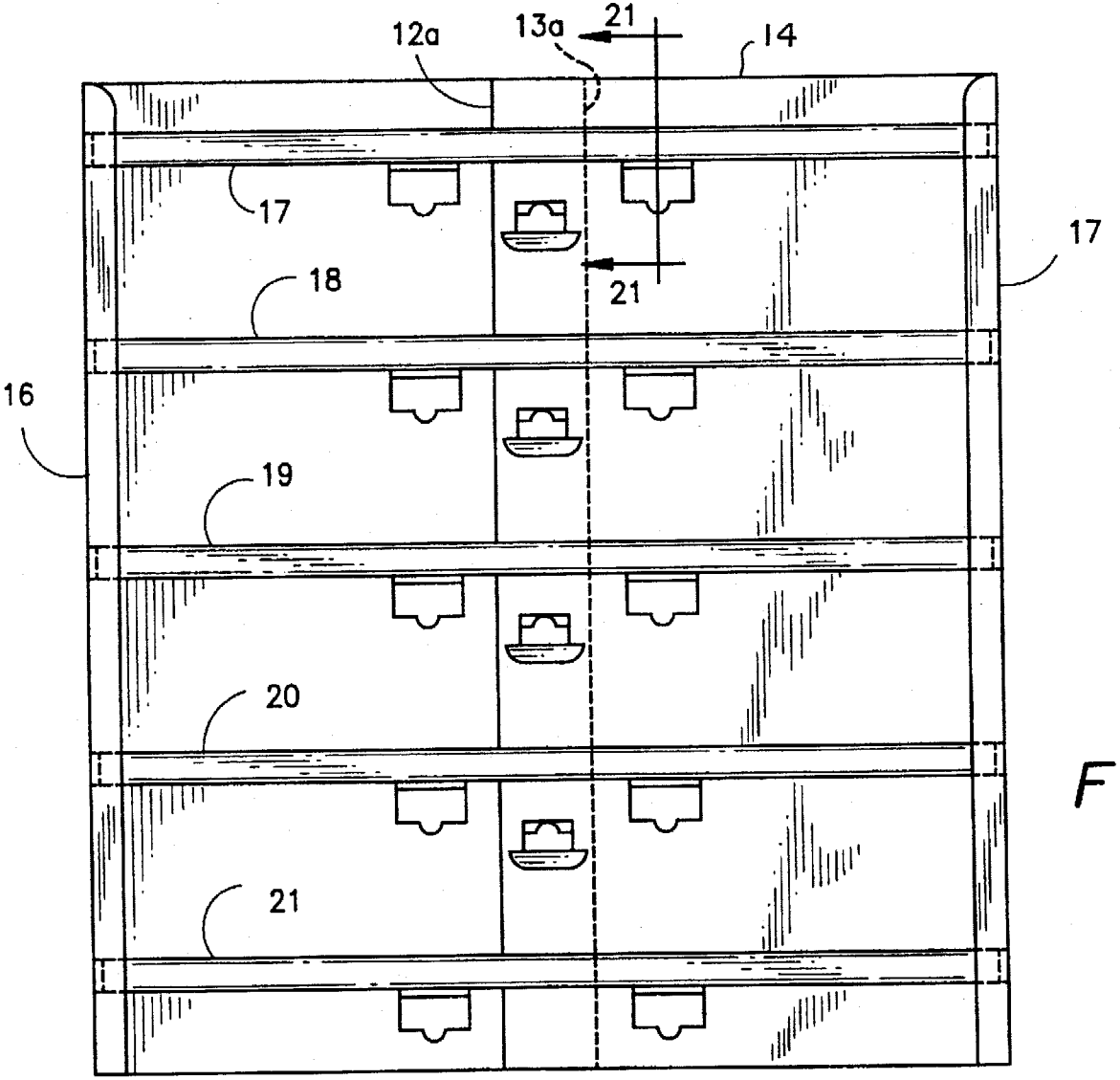
FIG. 2 a front view in elevation of the display shelf assembly of FIG. 1.
Figure 3:
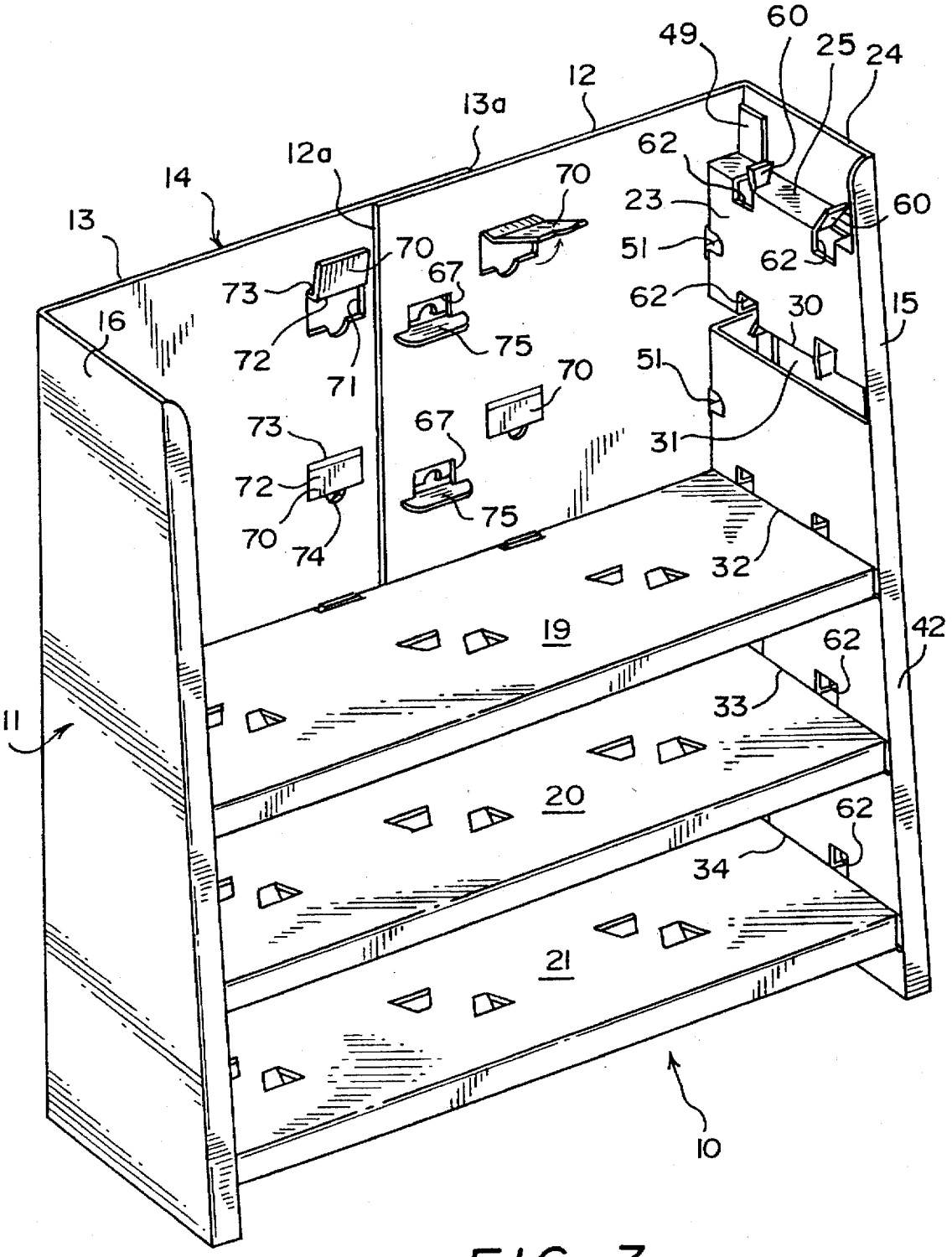
FIG. 3 is top, front perspective view of a display shelf assembly according to the invention, with some of the shelves removed to show details of construction of the back and side panels of the support sub-assemblies or members.
Figure 5:
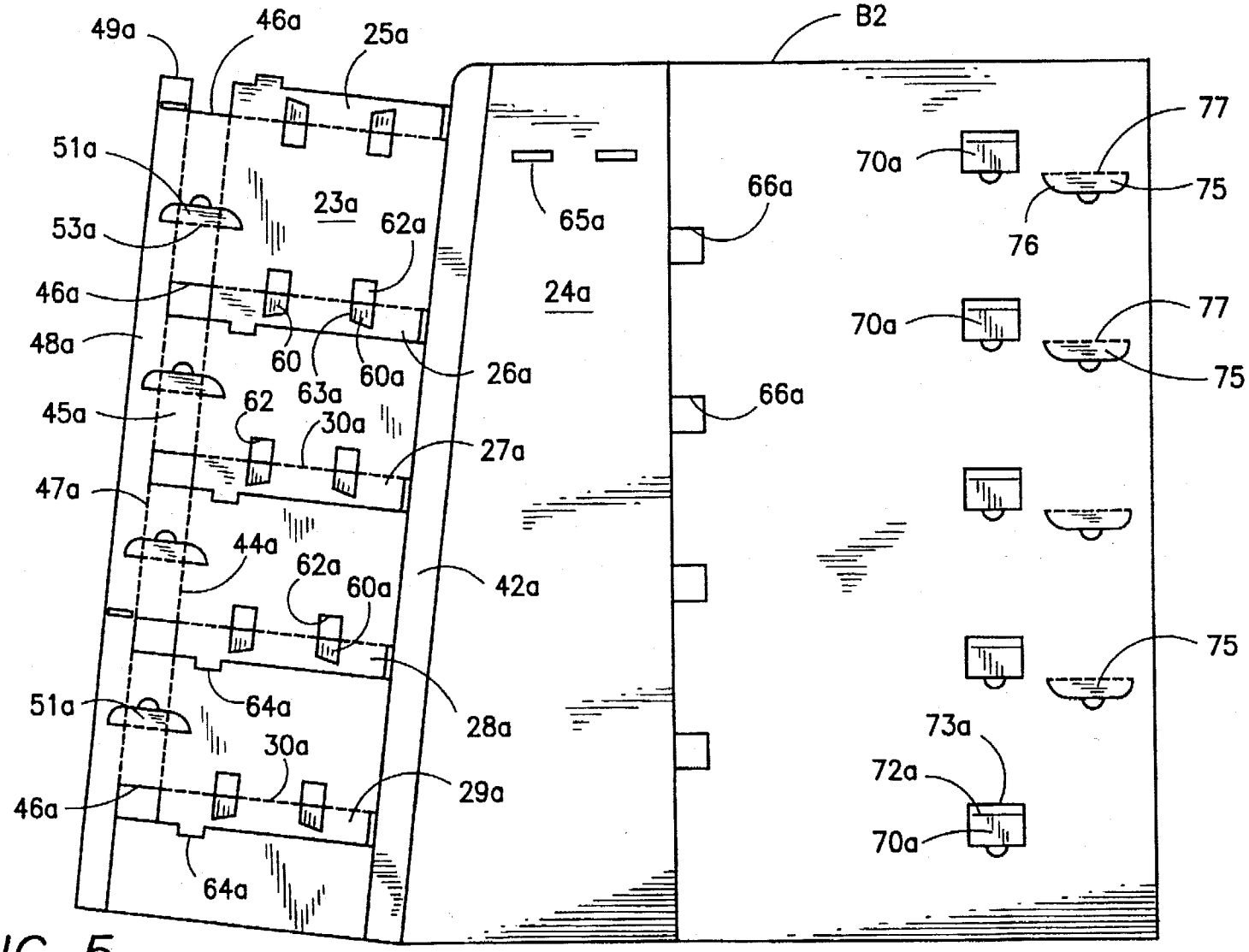
FIG. 5 is a plan view of the blank used to form the left side support member as viewed in FIGS. 1—3, showing the various score lines, cuts, openings, tabs and fold lines that are formed in the blank to enable the sub-assembly to be erected and engaged with the shelves to form the display shelf assembly of the invention.

The blank for forming the left hand side support member 13 is illustrated in FIG. 5 and is substantially identical to the blank for forming the right hand side support member 12. The only difference between this blank and that shown in FIG. 4 is that it is formed as a substantial mirror image of the blank forming side support member 12, and rather than the openings 67 which are present at one edge of panel B1 in right hand side support member 12, the panel B2 on left hand side support member 13 has a plurality of tabs 75 formed in positions to be placed in registry with the openings 67 when the panels B1 and B2 are positioned in overlapped relationship with one another. The tabs 75 are formed by a score line or cut 76 that extends around the bottom side of the tabs and inwardly along the top edges where the score line is interrupted to define a fold line 77. When the panels B1 and B2 are placed in overlapping relationship with one another at their adjacent edges as shown in FIGS. 1, 2 and 3, the tabs 75 are pulled through the openings 67 to lock the panels together. The remaining parts of this blank that are substantial duplicates of corresponding parts on right hand side support 12 are indicated by the same reference numerals followed by the designation "a", i.e., 23*a*, 24*a*, etc.

Figure 6:
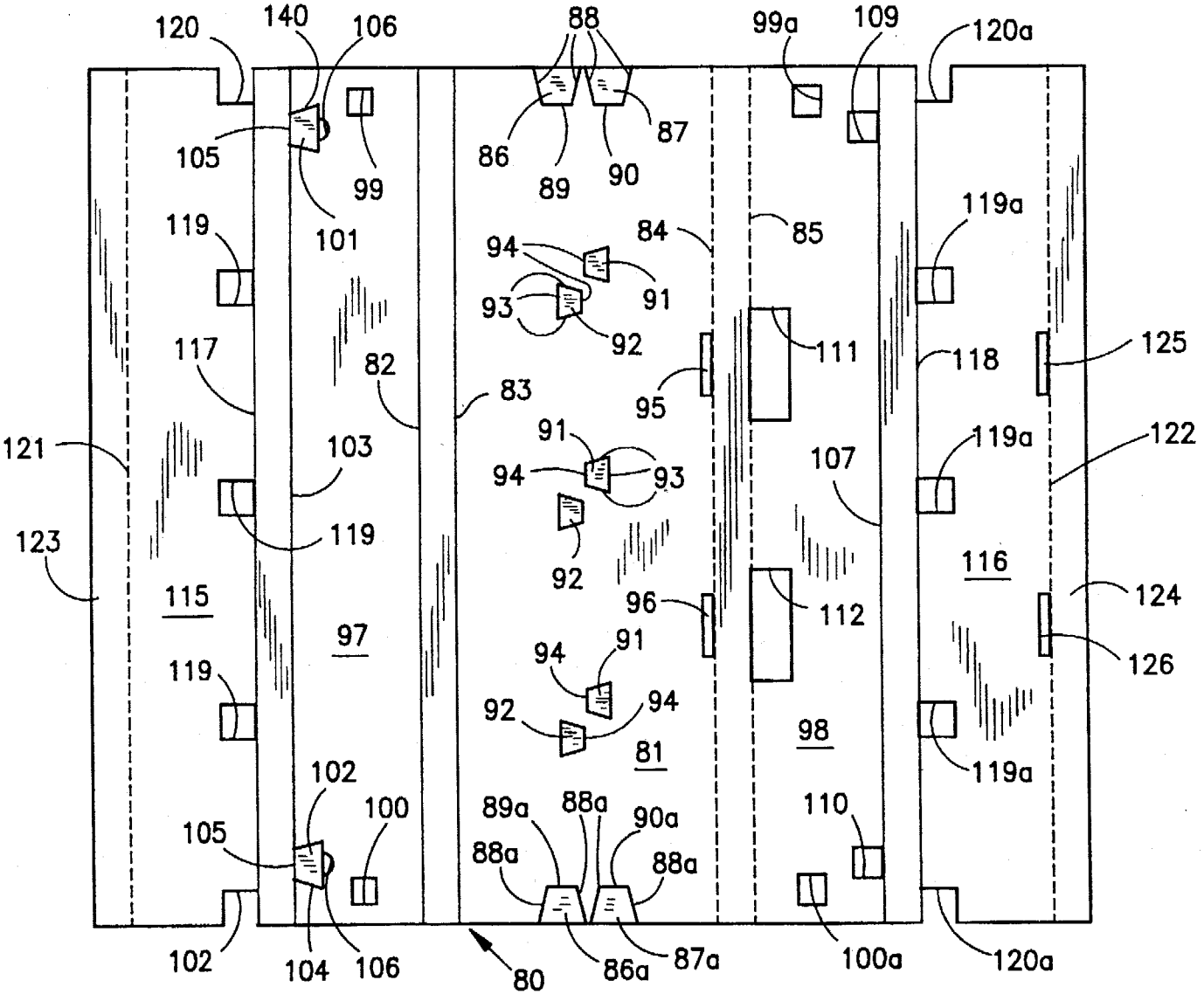
FIG. 6 is a plan view of the blank used in forming the top shelf unit in the display shelf assembly of the invention.

The blank for forming the top shelf unit 17 is indicated generally at 80 in FIG. 6. This blank includes a central, rectangularly shaped panel 81 having a first pair of relatively, closely spaced parallel fold lines 82 and 83 extending along one side and a second pair of similarly spaced elongate, parallel fold lines 84 and 85 extending along the other side. In the preferred embodiment, the fold lines 82 and 83 are formed by creases in the material of the blank while the fold lines 84 and 85 are perforated to facilitate bending. It should be understood, however, that any or all of the fold lines may be formed by creasing, scoring or perforating or other suitable means, as desired.

A first pair of bendable tabs 86 and 87 are formed at one end of the panel 81 by a series of diagonally extending cuts 88 extending inwardly from the outer end of the panel. The tabs 86 and 87 are joined to the panel by fold lines 89 and 90.

A similar pair of tabs 86*a* and 87*a* are formed at the opposite end of the panel 81 by cuts 88*a* and are joined to the panel by fold lines 89*a* and 90*a*.

Three pairs of bendable tabs 91, 92 are formed in the panel 81 at regularly spaced intervals along its center line by a series of cuts 93 extending around three sides of the tabs. It will be noted that the two side cuts extend diagonally toward one another at the base end of the tab, which is joined to the panel at a fold line 94.

Rectangular cut-outs 95 and 96 are formed in one side edge of the panel 81 adjacent fold line 84.

Second and third rectangular panels 97 and 98 are disposed on opposite sides of panel 81, and are joined thereto by the respective pairs of fold lines 82, 83 and 84, 85. It will be noted that each panel 97 and 98 is approximately one-half the width of panel 81.

Panel 97 has rectangular openings 99 and 100 in its opposite ends, and a pair of bendable tabs 101 and 102 along the outer side edge of thereof, which terminates in a fold line 103. The tabs 101 and 102 are formed by a cut 104 extending around three sides of the tab, and a fold line 105 which is coincident with the fold line 103. A finger access opening 106 is provided in the panel at the opposite end of each tab to facilitate access thereto.

Panel 98 extends between fold line 85 and fold line 107 at its outer edge, and has openings 99*a* and 100*a* at its outer ends in positions corresponding to the openings 99 and 100 in panel 97. In addition, panel 98 has openings 109 and 110 near its opposite ends and adjacent fold line 107, in substantial alignment with the tabs 101 and 102 in panel 97. A further pair of relatively large rectangular openings 111 and 112 are formed in panel 98 adjacent fold line 85, in substantial alignment with the openings 95 and 96 in panel 81.

Fourth and fifth rectangular panels 115 and 116 are joined to panels 97 and 98, respectively, by fold lines 117, 103 and 118, 107, respectively. The panels 115 and 116 are substantially equal in width to the panels 97 and 98, and the distance between fold lines 103 and 117 and between 107 and 118 is substantially equal to the distance between the fold lines 82 and 83 and 84 and 85, respectively.

Panel 115 has a series of rectangularly shaped openings 119 spaced equally along its length adjacent fold line 117, including cut-outs or notches 120 in the opposite ends of the panel.

Similar cut-outs or openings 119*a* and 120*a* are formed along one edge of panel 116, adjacent fold line 118.

The outer edges of panels 115 and 116 are defined by fold lines 121 and 122, respectively, leaving relatively narrow, elongate, rectangular flaps 123 and 124 at the outer side edges of the blank 80. These flaps 123 and 124 are of substantially the same width as the distances between the respective pairs of fold lines 82,83; 84,85; 103, 117 and 107, 118.

Figure 7:
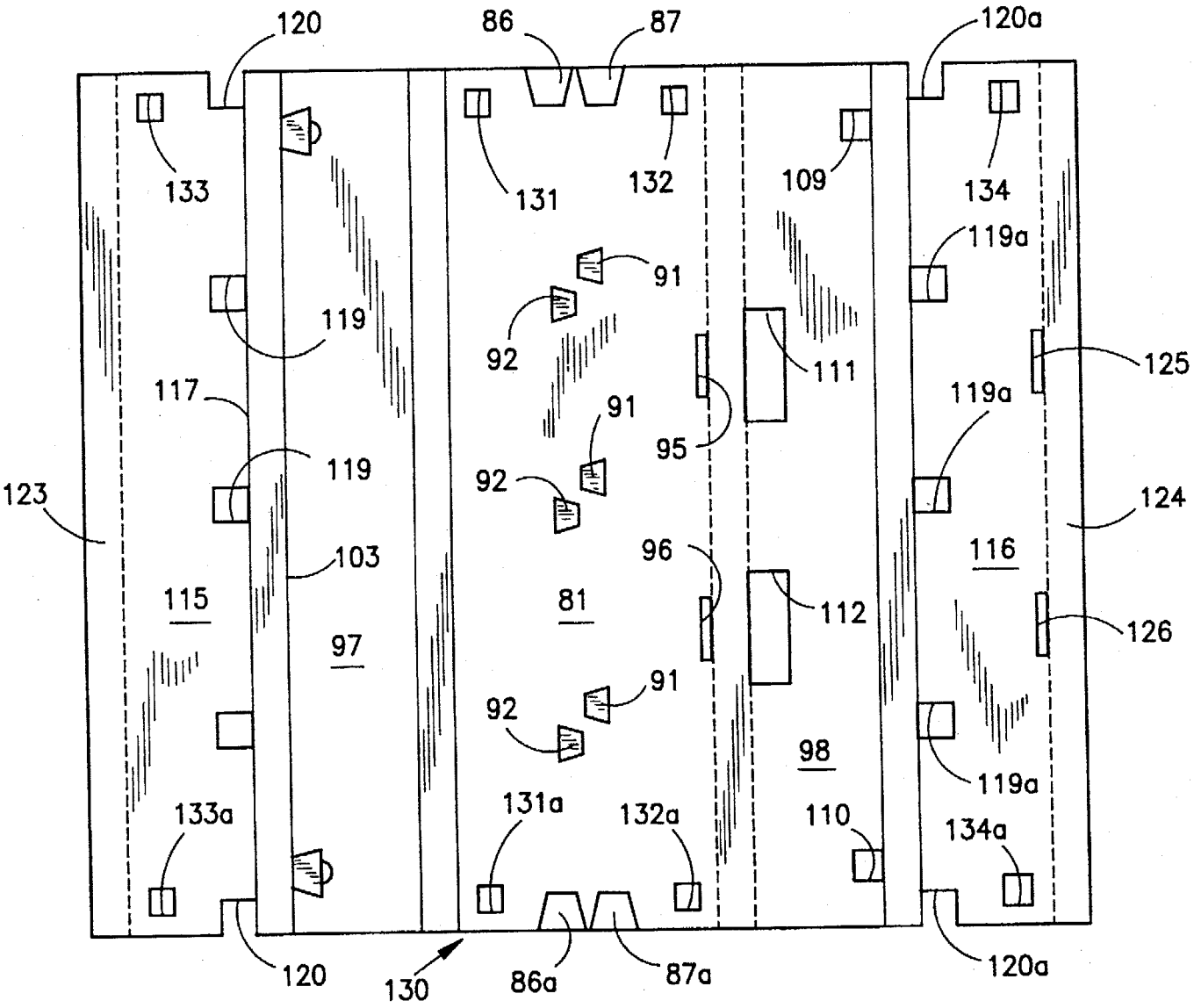
FIG. 7 is a top plan view of the blank used in forming the second and subsequent shelf units in the display shelf assembly of the invention, it being understood that the second shelf unit is slightly wider in a front to rear direction than the top shelf unit, and the third and subsequent shelf units are likewise successively wider in a front to rear direction than the next adjacent shelf unit above it.
Figure 8:
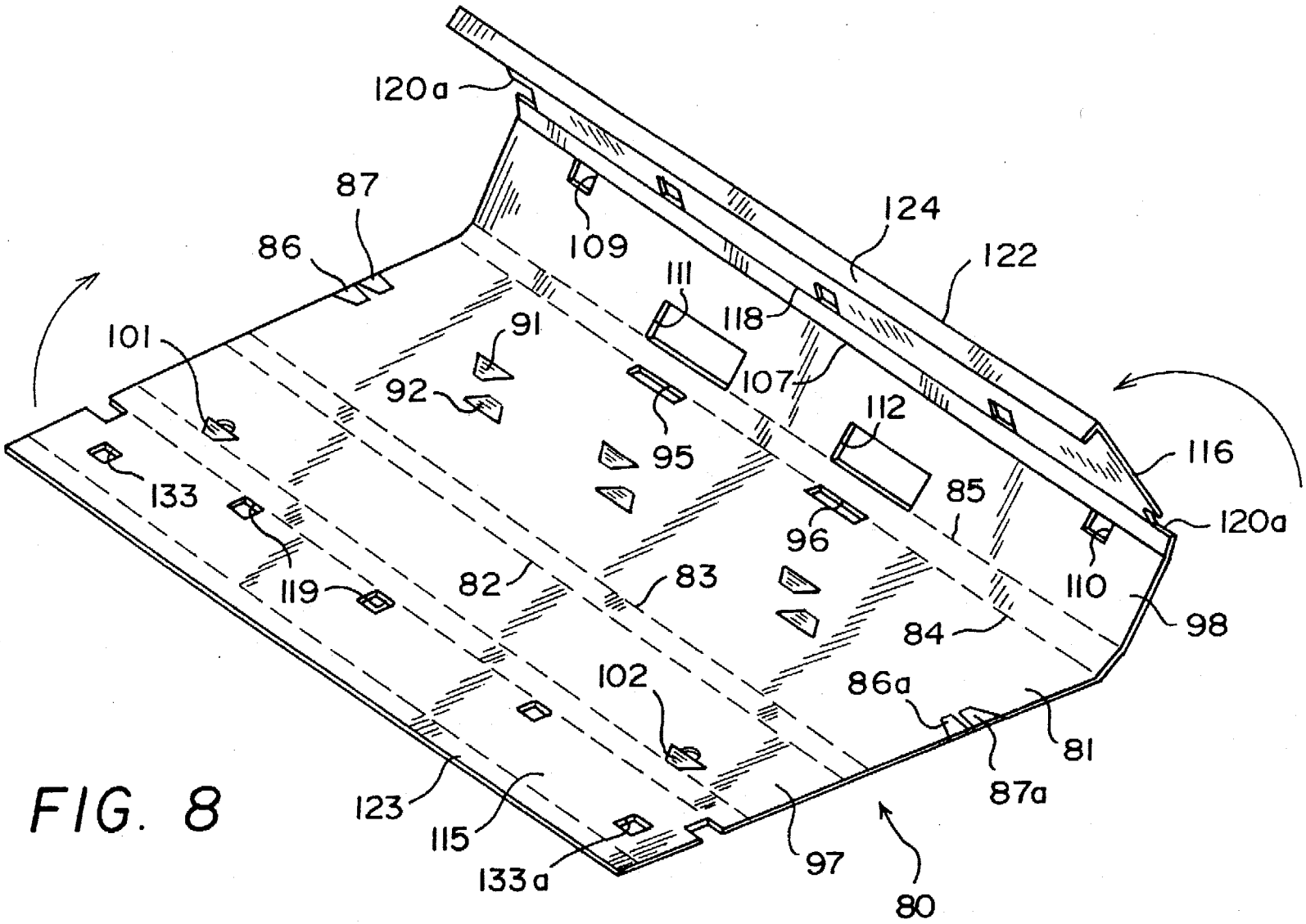
FIG. 8 is a top perspective view of the blank shown in FIG. 7, in the process of being folded to form the shelf unit.

A blank 130 for forming the second and subsequent shelves 18–21 in the display shelf assembly is shown in FIG. 7. This blank is formed substantially identically to blank 80, except that the openings 99,99*a* and 100,100*a* are omitted and a pair of similar openings 131, 132 and 131*a*, 132*a* are formed in the opposite ends of central panel 81 at opposite sides of the tabs 86, 87 and 86*a*, 87*a*, respectively. Additionally, a second pair of openings 133 and 133*a* are formed at opposite ends, respectively of panel 115*a*, and corresponding openings 134 and 134*a* are formed at opposite ends of panel 116*a*. In all other respects this blank is formed essentially the same as blank 80, and corresponding parts are indicated by the same reference numerals.

Figure 9:
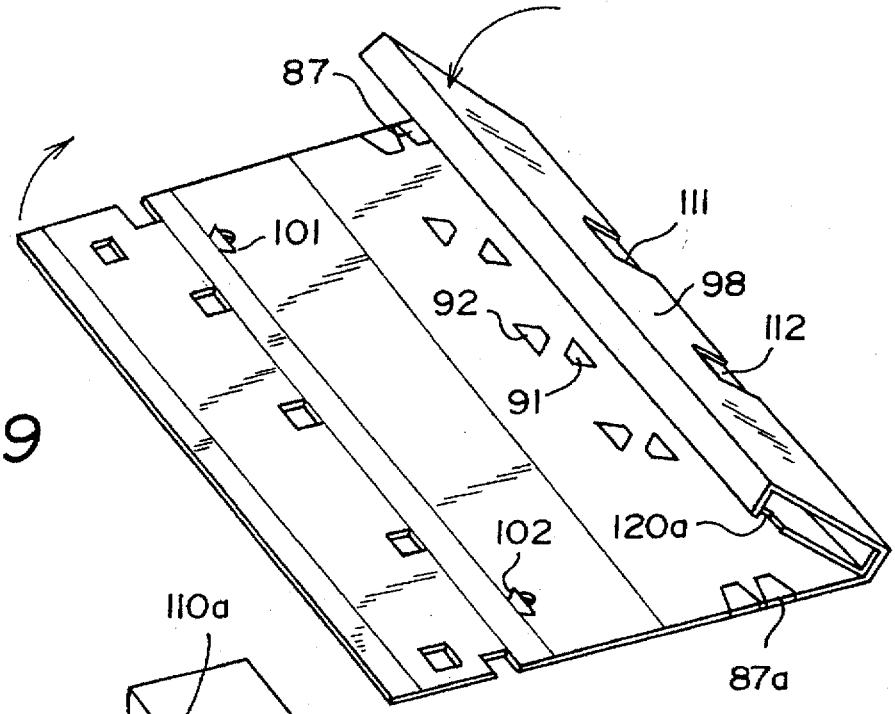
FIGS. 9, 10, 11 and 12 illustrate further successive steps in the process of folding the blank to form a shelf unit.
Figure 10:
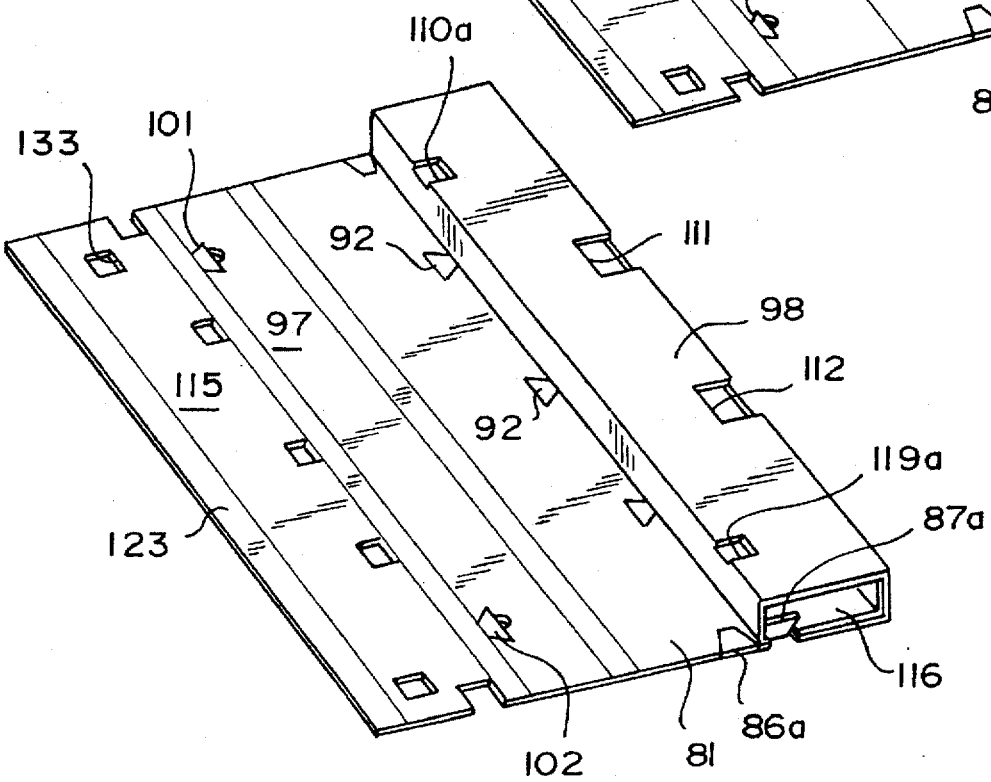

The steps of erecting the shelf unit 17 formed from blank 80 are illustrated in FIGS. 8–12. The blank is first folded from one or both of the outer side edges, shown here as initiating with the right hand side edge and flap 124. The flap 124 is folded about its fold line 122 and panel 116 is folded about fold lines 118 and 107 so that panel 124 and the panel between fold lines 107 and 118 are generally parallel to one another. The panel 98 is then folded about fold lines 84 and 85 as shown in FIGS. 9 and 10, until panel 116 lies flush against panel 81. Tabs 87 and 87*a* are then pulled through openings 120*a* at the opposite ends of panel 116 to secure the folded right hand side of the blank in the assembled relationship shown in FIG. 10. Panel 98 will then be disposed in parallel, spaced relationship to panel 81.

Figure 11:
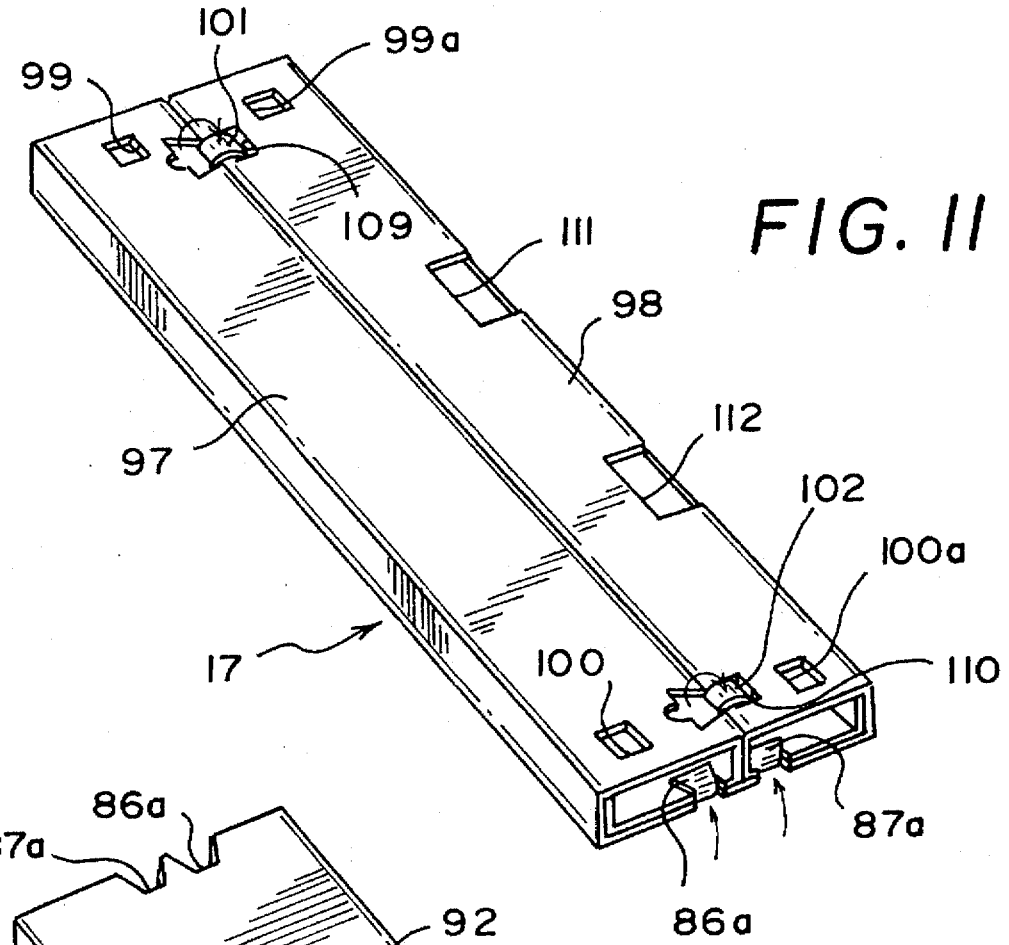

The opposite side of the blank is then folded inwardly, beginning with flap 123, until the blank assumes the shape shown in FIG. 11.

Figure 12:
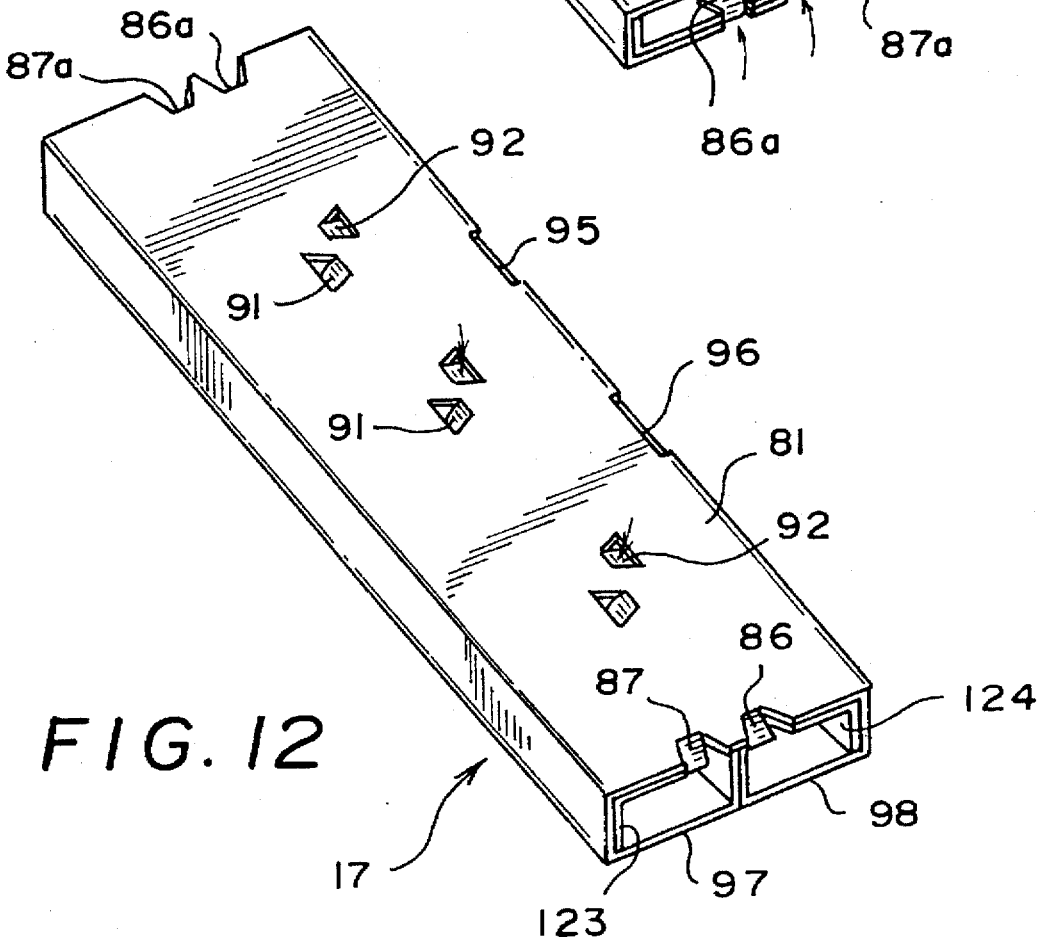
Figure 13:
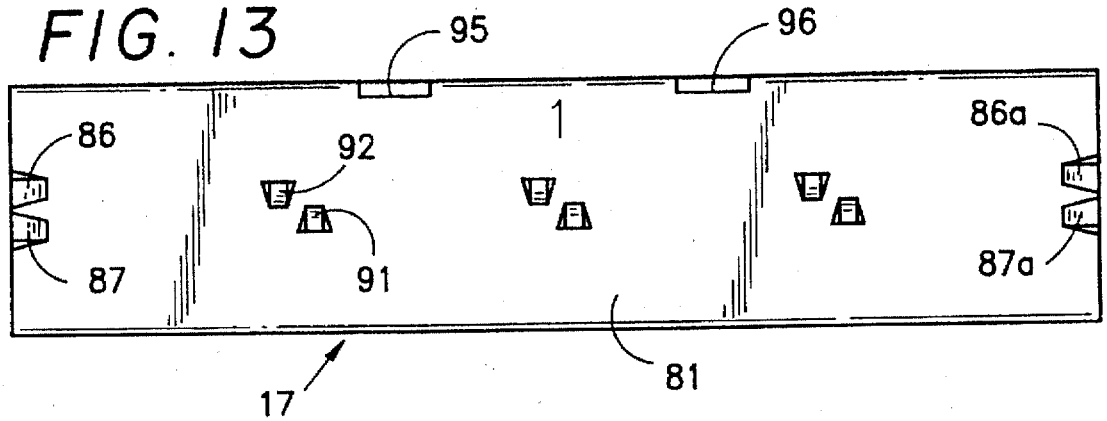
FIG. 13 is a top plan view of the uppermost shelf unit in the display shelf assembly, formed from the blank shown in FIG. 6.
Figure 14:
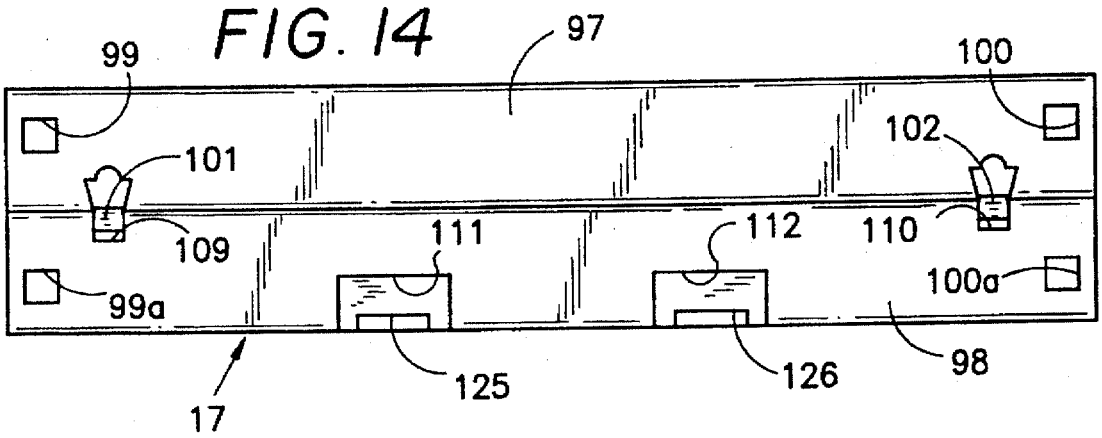
FIG. 14 is a bottom plan view of the uppermost shelf unit shown in FIG. 13.
Figure 15:
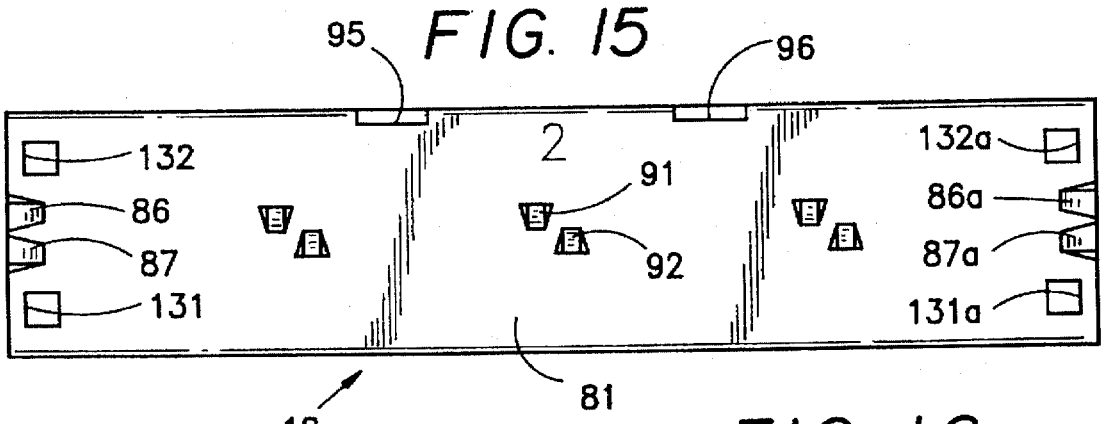
FIG. 15 is a top plan view of the second and subsequent shelf units used in the display shelf assembly, made from the blank shown in FIG. 7.
Figure 16:
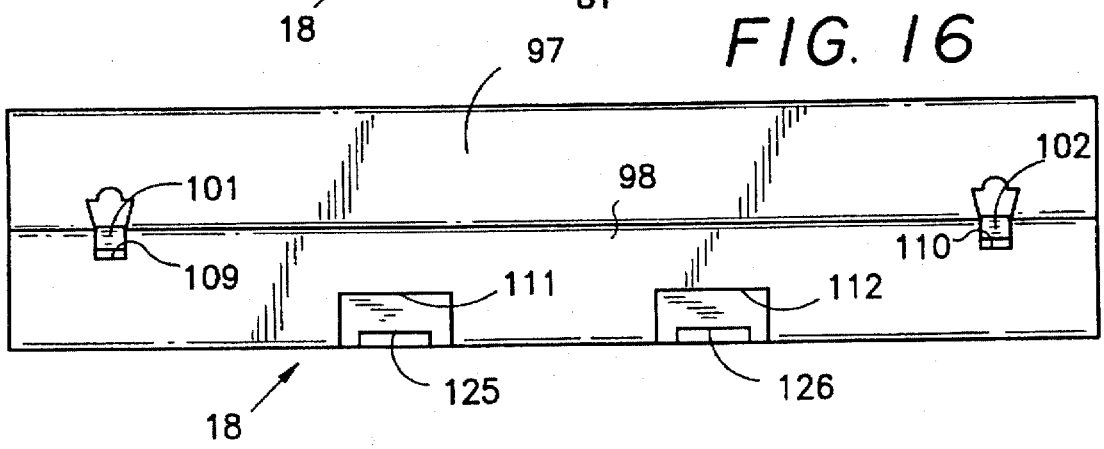
FIG. 16 is a bottom plan view of the shelf unit shown in FIG. 15.
Figure 17:
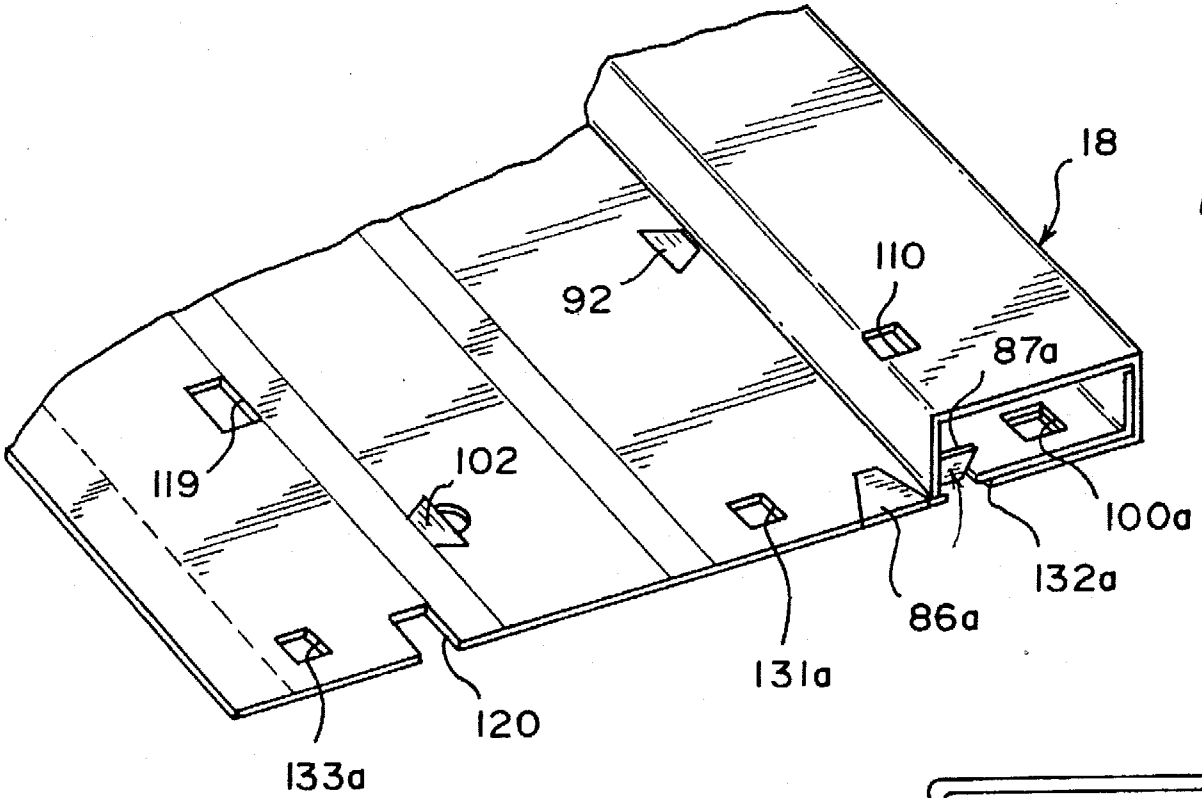
FIG. 17 is an enlarged, fragmentary, perspective view of one end of the shelf unit shown in FIG. 10, illustrating in greater detail the tabs and openings used to hold the shelf unit in assembled, folded relationship.
Figure 18:
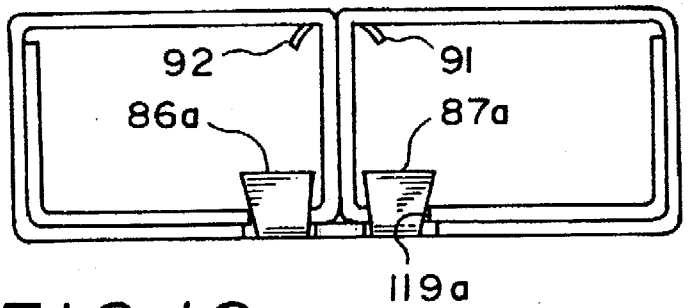
FIG. 18 is a further enlarged end view in elevation of the shelf unit of FIG. 17, shown in fully assembled condition.
Figure 20:
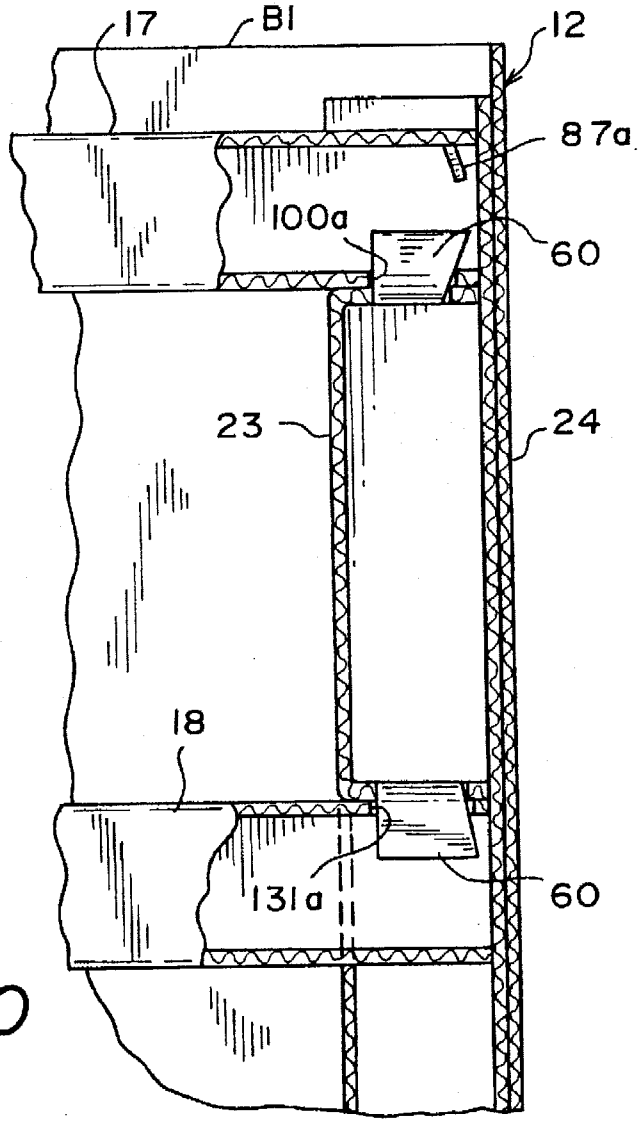
FIG. 20 is an enlarged fragmentary sectional view taken along line 20—20 in FIG. 1.
Figure 19:
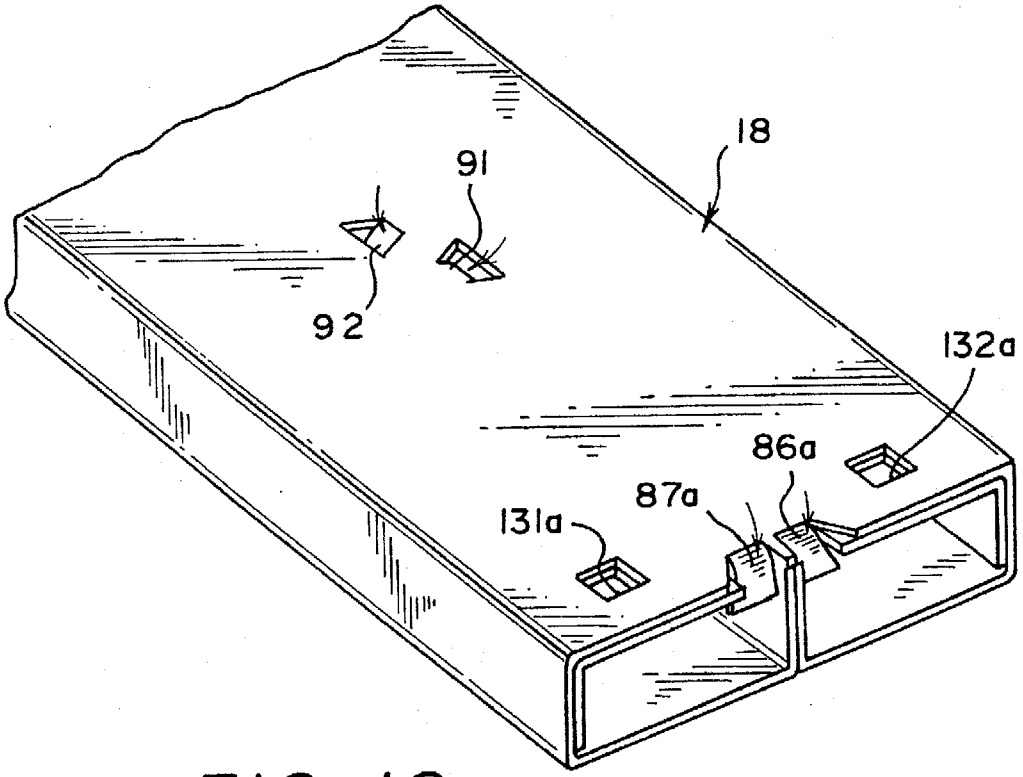
FIG. 19 is an enlarged, fragmentary, perspective view of the shelf unit shown in FIG. 12, illustrating with greater clarity the manner in which the tabs are pressed into complemental openings to hold the shelf unit in its folded, assembled relationship.
Figure 21:
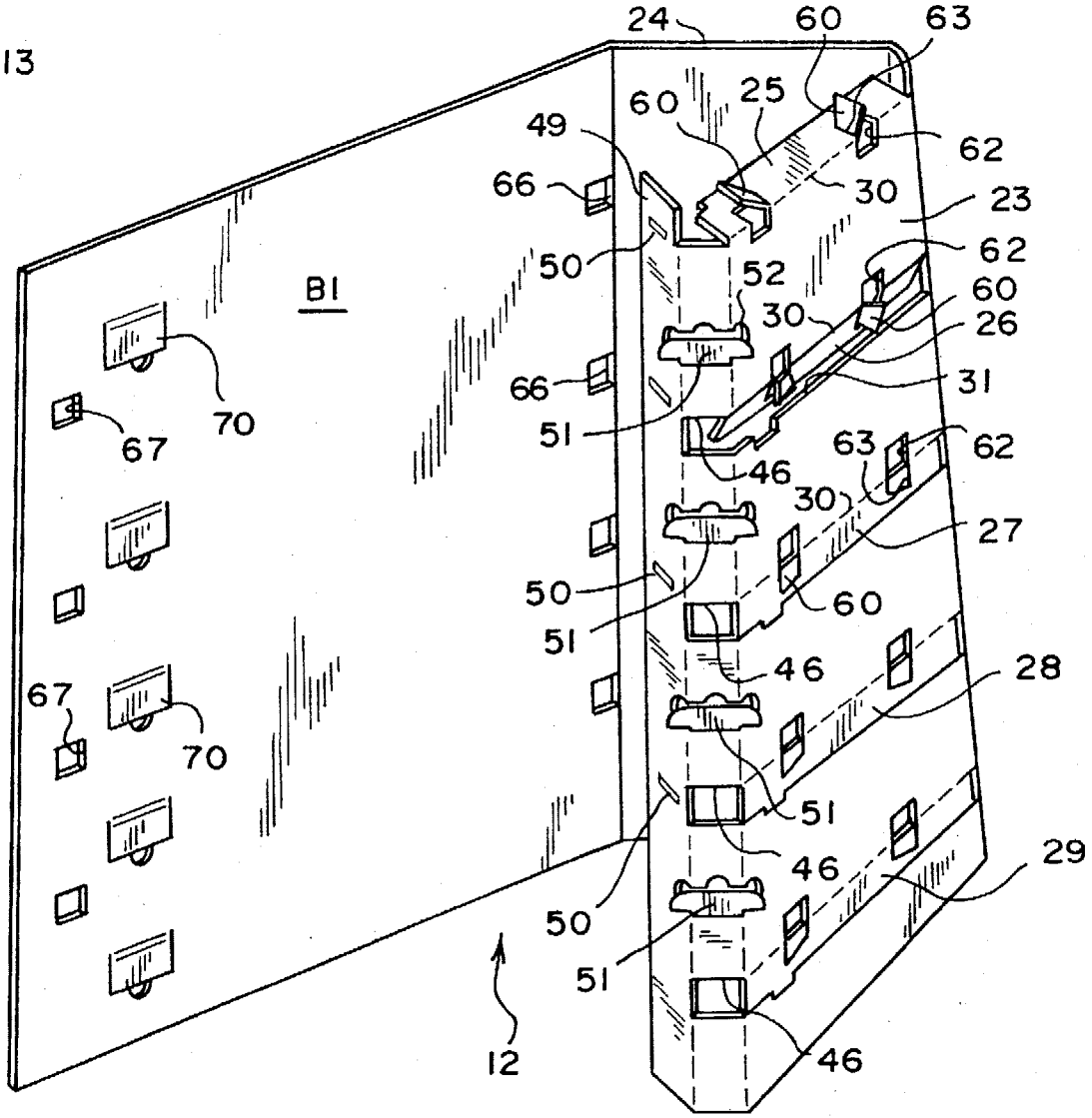
FIG. 21 is an enlarged fragmentary view in section taken along 21—21 in FIG. 2.

After the blank 80 has been folded inwardly to the position shown in FIG. 11, the topmost shelf unit 17 is essentially completed. With the opposite panels 115 and 116 folded inwardly into adjacent parallel relationship with one another as shown in FIG. 11, the tabs 101 and 102 are folded over the confronting edges of panels 97 and 98 and inserted downwardly through the openings 109 and 110 in panel 116. The tabs 86,86*a* and 87,87*a* have previously been folded inwardly through the aligned openings 120 and 120*a* in opposite ends of panels 115 and 116, respectively. The shelf unit 17 is then flipped over to the position shown in FIG. 12, and the tabs 91 and 92 are pushed downwardly through aligned openings 119 and 119*a* in panels 115 and 116, respectively, which underlie the panel 81 in the assembled shelf unit. This effectively locks the shelf unit in its fully folded assembled condition as shown in FIGS. 11 and 12. It will further be noted that in this fully folded condition, the slots 95 and 125 in panels 81 and 116, respectively, are in aligned relationship with the opening 111 in panel 98, and openings or slots 96 and 126 in panels 81 and 116 are similarly in alignment with opening 112 in panel 98.

Further, it will be observed that this top shelf unit 17 has the openings 99,99*a* and 100,100*a* at opposite ends thereof in panels 97 and 98, respectively, disposed on the underside Of the shelf. That is, the orientation shown in FIG. 12 is the operative orientation of the shelf unit when it is assembled to the support housing, with the panel 81 comprising the top surface of the shelf unit and panels 97 and 98 comprising the bottom surface. Thus, when the shelf unit 17 is installed on the support members 12 and 13, the tabs 60 in panels 25 and 25*a* on the respective support members may be folded upwardly and inserted into the openings 99,99*a* and 100, 100*a* to lock the shelf unit in place on the support members. Similarly, the tabs 70 and 70*a* on the back panels B1 and B2 of the support members may be folded upwardly about their fold lines 72 and 73 and inserted through the openings 111 and 112 in the underside of the shelf unit, and extended through the slots 125 and 126 into the slots 95 and 96 in top panel 81, thus also locking the shelf unit to the back panels of the support.

Similarly, the second and subsequent lower shelf units 18–21 are assembled to the support by engaging the tabs on the support in associated openings in the shelf unit. In contrast to the attachment of the top shelf unit to the support, it will be noted that flaps 26,26*a* through 29,29*a* or the opposed walls of the side panels are folded about their top edges 30,30*a* rather than their bottom edges as on the top flaps 25,25*a*, whereby the tabs 60 on these succeeding flaps are folded downwardly into the aligned openings 131,131*a* and 132,132*a* in the top panel 81 of the lower shelf units 18–21. In all other respects, assembly of the lower shelf units to the support is the same as that for the top shelf unit, and each shelf unit is locked both to the side panels and to the back panels of the support assembly.

Figure 22:
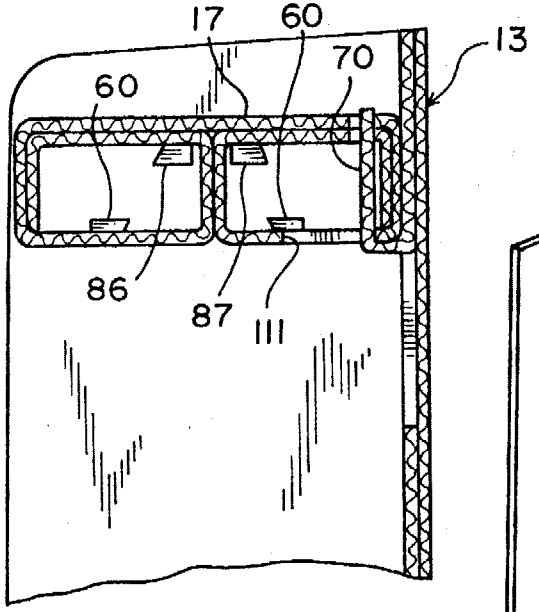
FIG. 22 is a front perspective view of the blank used to form the right hand support for the shelf assembly, shown in partially folded relationship.

Further, and with particular reference to FIGS. 3, 22 and 23, the multi-wall side panels 15 and 16 are secured to the back panels B1 and B2, respectively, by pulling tabs 51 through the aligned openings 66 and 66*a* in the respective associated back panels B1 and B2.

Figure 24:
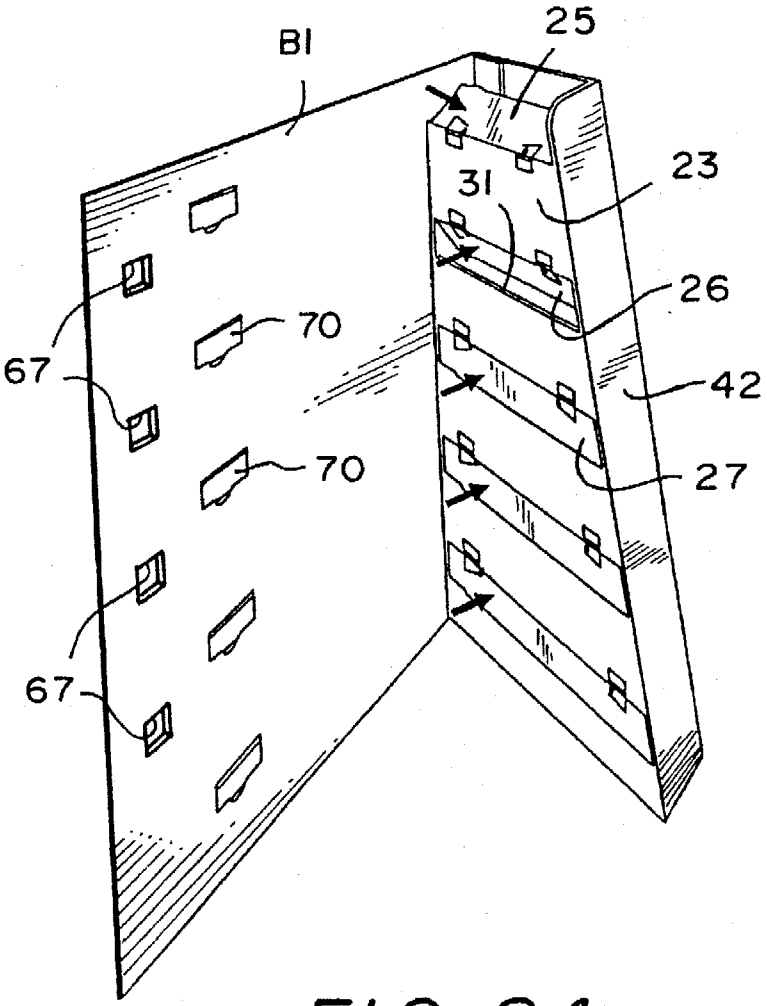
FIGS. 23 and 24 are further perspective views of the right hand support member, shown in further successively folded relationships.

Following assembly of the side support members 12 and 13 as illustrated in FIGS. 22–24, one of the side support members (shown here as 12) is laid on its back on a supporting surface and one end of the shelf units is inserted into the respective openings 31–34 and secured by engagement of the tabs 60 in the associated openings 131,131*a* and 132, 132*a* in the top surfaces of shelves 18–21. The top shelf 17 is positioned on top of the shoulder formed by flap 25 and secured by inserting the tabs 60 into the openings 99,100 and 99*a*,100*a* in the underside of that shelf unit.

Figure 26:
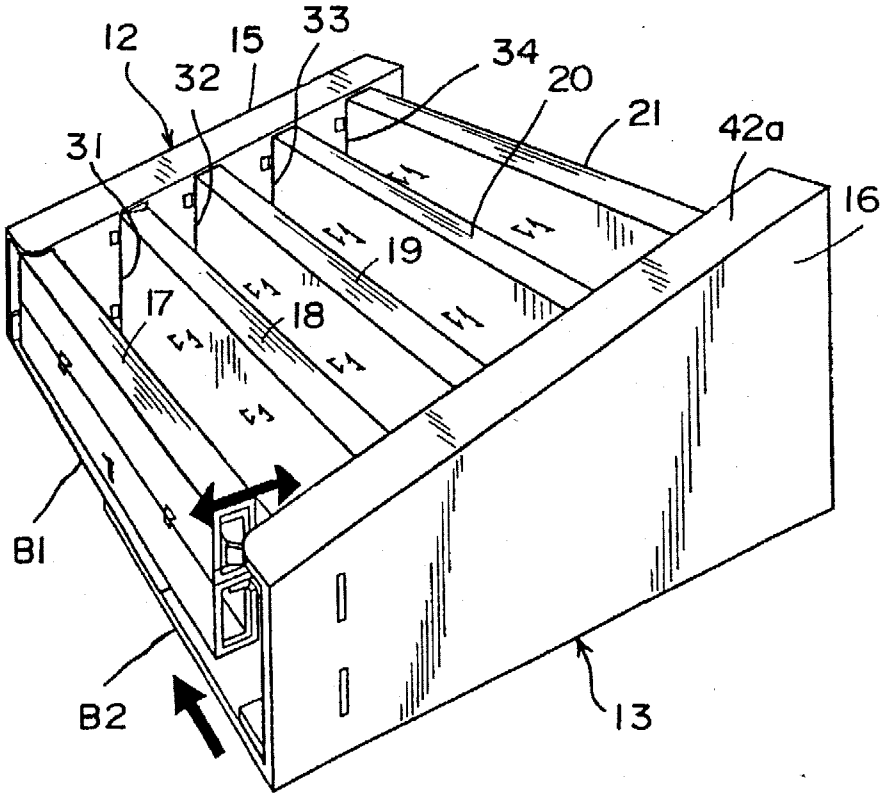
FIG. 26 illustrates how the left hand support member is moved into position relative to the right hand support member and to the shelf units during a final stage of assembly of the invention.
Figure 25:
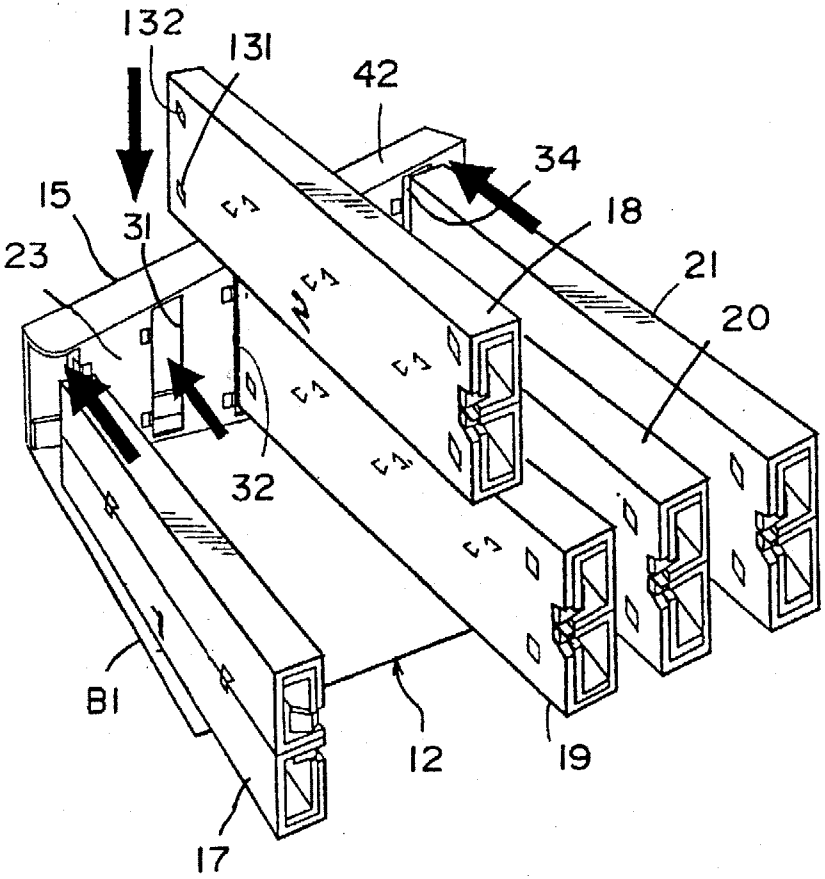
FIG. 25 illustrates the manner in which the assembled shelf units are inserted into the complemental openings formed in the right hand support member during assembly of a display shelf assembly according to the invention.

After the ends of the shelf units 17–21 have been secured to the associated side panel 15, the other side support 13 is slid into position as shown in FIG. 26, and the opposite ends of the shelf units are secured to the side panel 16 in the same way that the first ends were secured to side panel 15.

The display shelf assembly is then stood up as shown in FIGS. 27 and 28 and the tabs 75 are pulled through the openings 67 to secure the back panels B1 and B2 together. Similarly, the tabs 70 are pushed forwardly through the backs of the associated side supports and folded upwardly through the openings 111, 112 and 125, 126 into the openings 95 and 96 in the respective shelf units.

FIGS. 17–21 simply show in greater detail the construction and operation of the various tabs and complemental recesses for securing the display shelf assembly of the invention in its assembled relationship.

It will thus be apparent that the display shelf assembly of the invention is relatively simple and economical in construction and does not require the use of adhesives or hardware in its assembly. Moreover, since the entire display shelf assembly is made of a paper material, it is easily recyclable. Further, the multi-wall construction of the side panels 15 and 16 and the manner of construction of the shelves 17–21 results in a strong construction which is capable of supporting relatively heavy loads, while at the same time providing open and unobstructed spaces for display of items stored on the shelf assembly.

While a particular embodiment of the invention have been illustrated and described in detail herein, it should be understood that various changes and modifications may be made to the invention without departing from the spirit and intent of the invention as defined by the scope of the appended claims.

What is claimed is:

1. A display shelf assembly, comprising:

a support housing having a generally upright back panel means with opposite side edges, a side panel extending forwardly from each of the opposite side edges of the back panel means and terminating in a forward free edge, each said side panel comprising spaced apart inner and outer parallel walls, said inner wall having at least one elongate rectangular opening or slot formed therein, extending in a front-to-rear direction; and at least one shelf unit extending between the side panels and having its opposite ends extended through an associated slot in each of the side panel inner walls to hold the shelf in generally horizontal, supported position between the side panels.

2. A display shelf assembly as claimed in claim 1, wherein: there are a plurality of elongate rectangular openings or slots formed in the inner wall of each side panel, said slots spaced uniformly throughout the height of the respective panel; a plurality of shelf units extend between the side panels in generally parallel, vertically spaced relationship to one another; and each shelf unit extends into an associated slot in a respective side panel.

3. A display shelf assembly as claimed in claim 2, wherein:

said support housing and shelf units are formed of corrugated liner board.

4. A display shelf assembly as claimed in claim 3, wherein:

each slot in the side panels is formed by a cut defining an elongate flap that is movable about a fold line into a generally horizontal position between the inner and outer walls of the side panel, said flap defining a support shoulder on which the associated end of a shelf unit rests when it is engaged in a slot.

5. A display shelf assembly as claimed in claim 4, wherein:

the foldable flap has a free edge with a tab on the free edge, and the outer wall has a slot in which the tab is received to hold the flap in a horizontal position extending between the inner and outer walls.

6. A display shelf assembly as claimed in claim 1, wherein:

interengaged tab and recess means are between the shelf and the back panel means to secure the shelf to the back panel means and assist in supporting the shelf between its ends.

7. A display shelf assembly as claimed in claim 1, wherein:

the support housing comprises two separate, secured together components comprising a left side support member and a right side support member, and the back panel means comprises first and second back panels having adjacent overlapping edges, said edges being secured together by interengaged tab and recess means.

8. A display shelf assembly as claimed in claim 1, wherein:

the side panels each comprises a blank folded about fold lines to define said inner and outer spaced apart walls, with narrow rectangular panels extending between opposite edges of the inner and outer walls, defining a box-like structure for each side panel.

9. A display shelf assembly as claimed in claim 1, wherein:

said shelf unit is formed from a flat, rectangular blank longitudinally divided by fold lines into a center panel and a plurality of secondary panels along each of opposite longitudinal side edges of the center panel, said plurally of secondary panels each having a width less than the width of the center panel and being successively folded inwardly over one another from each of the respective opposite longitudinal side edges of the center panel into parallel relationship with each other and with the center panel, whereby the center panel forms an unbroken shelf support surface on which items may be supported, and the secondary panels form multiple box beam structures beneath the center panel to support it.

10. A display shelf assembly as claimed in claim 7, wherein:

there are a plurality of elongate rectangular openings or slots formed in the inner wall of each side panel, said slots spaced uniformly throughout the height of the respective panel; a plurality of shelf units extend between the side panels in generally parallel, vertically spaced relationship to one another; and each shelf unit extends into an associated slot in a respective side panel.

11. A display shelf assembly as claimed in claim 10, wherein:

said support housing and shelf units are formed of corrugated liner board.

12. A display shelf assembly as claimed in claim 8, wherein:

each slot on the side panels is formed by a cut defining a flap that is movable about a fold line into a generally horizontal position between the inner and outer walls of the side panel, said flap defining a support shoulder on which the associated end of a shelf unit rests when it is engaged in a slot.

13. A display shelf assembly as claimed in claim 12, wherein:

the foldable flap has a free edge with a tab on it and the outer wall has a slot in which the tab is received to hold the flap in a horizontal position extending between the inner and outer walls.

14. A display shelf assembly as claimed in claim 7, wherein:

interengaged tab and recess means are between the shelf and the back panel means to secure the shelf to the back panel means and assist in supporting the shelf between its ends.

15. A display shelf assembly as claimed in claim 8, wherein:

said shelf unit is formed from a flat, rectangular blank longitudinally divided by fold lines into a center panel and a plurality of secondary panels along each of opposite longitudinal side edges of the center panel, said plurality of secondary panels each having a width less than the width of the center panel and being successively folded inwardly over one another from each of the respective opposite longitudinal side edges of the center panel into parallel relationship with each other and with the center panel, whereby the center panel forms an unbroken shelf support surface on which items may be supported, and the secondary panels form multiple box beam structures beneath the center panel to support it.

16. A display shelf assembly as claimed in claim 8, wherein:

one of the narrow rectangular panels extending between the inner and outer walls of the side panel defines a front edge for the side panel and the opposite narrow rectangular panel lies in parallel, contiguous relationship against the back of the support housing; and interengaged tab and recess means are between said opposite rectangular panel and the back to hold the side panel in its operative folded relationship.

17. A display shelf assembly as claimed in claim 9, wherein:

there are a plurality of elongate rectangular openings or slots formed in the inner wall of each side panel, said slots spaced uniformly throughout the height of the respective panel; a plurality of shelf units extend between the side panels in generally parallel, vertically spaced relationship to one another; and each shelf unit extends into an associated slot in a respective side panel.

18. A display shelf assembly as claimed in claim 9, wherein:

said support housing and shelf units are formed of corrugated liner board.

19. A display shelf assembly as claimed in claim 9, wherein:

the support housing comprises two separate, secured together components comprising a left side support member and a right side support member, and the back panel means comprises first and second back panels having adjacent overlapping edges, said edges being secured together by interengaged tab and recess means.

20. A display shelf assembly as claimed in 19, wherein:

said side panels each comprises a blank folded about fold lines to define said inner and outer spaced apart walls, with narrow rectangular panels extending between opposite edges of the inner and outer walls, defining a box-like structure for each side panel.

* * * * *